US008008577B2

(12) United States Patent
Lima et al.

(10) Patent No.: US 8,008,577 B2
(45) Date of Patent: Aug. 30, 2011

(54) CONSTRUCTIVE ARRANGEMENT IN AN UMBILICAL CABLE AND A PROCESS FOR THE MANUFACTURE THEREOF

(75) Inventors: Aloísio José de Ollveira Lima, Santo André (BR); Antonio Pereira Filho Do Nascimento, Santo André (BR); Carlos Alberto Godinho Ferreira, Santo André (BR)

(73) Assignee: Prysmian Energia Cabos E Sistemas Do Brasil S.A., Sorocaba, SP (BR)

( * ) Notice: Subject to any disclaimer, the term of this patent is extended or adjusted under 35 U.S.C. 154(b) by 0 days.

(21) Appl. No.: 12/448,369

(22) PCT Filed: Dec. 21, 2006

(86) PCT No.: PCT/BR2006/000287

§ 371 (c)(1), (2), (4) Date: Nov. 13, 2009

(87) PCT Pub. No.: WO2008/074104

PCT Pub. Date: Jun. 26, 2008

(65) Prior Publication Data

US 2010/0059247 A1 Mar. 11, 2010

(51) Int. Cl.
*H01B 9/02* (2006.01)

(52) U.S. Cl. ..... 174/103; 174/113 R

(58) Field of Classification Search ..... 174/113 R, 174/103, 105 R
See application file for complete search history.

(56) References Cited

U.S. PATENT DOCUMENTS

| | | | | |
|---|---|---|---|---|
| 2,216,340 | A * | 10/1940 | Elliott | 174/103 |
| 6,472,614 | B1 | 10/2002 | Dupont et al. | |
| 2002/0092667 | A1 | 7/2002 | Dalrymple et al. | |

* cited by examiner

*Primary Examiner* — Chau N Nguyen
(74) *Attorney, Agent, or Firm* — Finnegan, Henderson, Farabow, Garrett & Dunner, L.L.P.

(57) ABSTRACT

An umbilical cable, particularly adequate for subsea exploration, contains two or more three-phase power supply circuits, each consisting of three conductors grouped in a trefoil configuration, each conductor including a metal core surrounded by an insulating sheath, each conductor being provided with an individual shielding whose cross-section is less than, equal to or greater than that of the core. Advantageously, each insulating sheath may be surrounded by a layer of semiconductor material. Filler spacers made of an insulating material, preferably polyethylene, may be used to aid in the positioning of the trefoils. The cable provides an economy of material, an increased flexibility, a reduction of the diameter of the finished cable and a substantial decrease of manufacturing time as compared with cables produced in accordance with the known art. A manufacturing method for an umbilical cable is also disclosed.

18 Claims, 1 Drawing Sheet

CONSTRUCTIVE ARRANGEMENT IN AN UMBILICAL CABLE AND A PROCESS FOR THE MANUFACTURE THEREOF

CROSS REFERENCE TO RELATED APPLICATION

This application is a national phase application based on PCT/BR2006/000287, filed Dec. 21, 2006, the content of which is incorporated herein by reference.

FIELD OF THE INVENTION

The present invention refers to the field of electric power conductor cables, and refers more particularly to the cables used to supply electric power at medium and high voltages to heavy-duty equipments, such as, for example, the ones employed in subsea oil exploration.

DESCRIPTION OF THE PRIOR ART

The search for new oil reservoirs has led to the prospecting and exploration in the sea bed, not only in the continental shelf, but also in deeper waters. There are at present wells extending to depths in the order of 2 kilometers, whose operation requires the development of specific technologies, substantially different from those traditionally employed at water depths of less than 300 meters.

One important aspect of such technologies is related to the extraction and conveyance of the oil from the wellhead to the surface, which is done by means of electrically driven high-power pumps, installed in the vicinity of the Christmas tree. The power used by these pumps must be supplied from a fixed or semi-submersible platform located on the surface. The means that convey said power between the platforms and the pumps are designated as "Umbilical Cables", and these must be manufactured to meet the extremely harsh conditions of the environment where they are used, as well as they must have a durability compatible with the useful life of the wells, which is typically in the order of 25 years.

In view of the dependability required from the pumping systems, the umbilical cable must supply power to at least two pumps, one main pump and one backup pump. This figure may be increased to five or even more units, depending on the characteristics of the well. In all instances, three-phase power is supplied to the pumps.

FIG. 1 is a cross-sectional view of an umbilical cable built according to the known art, designed to transmit power to up to five pumps. Said cable 10 comprises five independent power supply circuits, each circuit 11 comprising three conductors 12 corresponding to the three phases, in a so-called triplexed configuration, sheathed in a polyethylene cover 13, with the interstitial voids 14 filled with an extruded resin such as PVC, said triplex arrangement 11 having a substantially cylindrical shape. As shown, the five circuits are grouped around a polyethylene core 15, whose high mechanical strength allows it to withstand the hydrostatic pressure found at great depths. Completing the umbilical cable, there is provided an internal polyethylene sheath 16, a steel shielding 17 and an outer polyethylene sheath 18, with the voids between the triplex arrangements and between these and the internal sheath being filled with an extruded thermoplastic material 19, typically consisting of PVC.

This known umbilical cable possesses some shortcomings, such as the time required for its production. Firstly, such production requires two passages through the cabling machine, the first to form the triplex arrangements 11 with the respective sheaths and temporary storage thereof in bobbins. The second step comprises the placement of said bobbins (in the case at hand, there are five bobbins), in the cabling machine, whereupon said triplex arrangements 11 are grouped in one single assembly forming the umbilical cable. Furthermore, the bobbins used for temporary storage of the triplex cables 11 cannot hold the entire amount of material required to manufacture cables for deepwater use, which may be up to 12 kilometers long. Actually, said bobbins can store only 1000 to 1500 meters of triplex cable 11, and thus the production of long umbilical cables must include the splicing of successive segments 11. To achieve the high level of reliability required, special techniques are used in such splices, which are time-consuming and expensive. Typically, for an umbilical cable formed by conductors with a cross-sectional area of 240 square millimeters each, there three days are needed to splice the three conductors of a triplex arrangement. This means that with a cable such as the one depicted in FIG. 1, the operation of the cabling machine (in which the triplex cables are grouped together, the interstitial voids are filled with extruded thermoplastics and the outer sheaths are applied) must be interrupted during 15 days for the execution of each set of splices. Considering the above mentioned limit in storage capacity of the bobbins, it follows that for the longest umbilical cables, the time consumed by said splicing operations may take up to 150 days, such period exceeding by far that which is required for the remaining manufacturing operations.

Another disadvantage of the cable illustrated in FIG. 1 resides in its excessive stiffness, due in part to filling with thermoplastic material all its internal voids 14, 19, as well as the diameter of the cable, which in the cited example reaches 250 mm. Such rigidity requires large-diameter bobbins to store the cable, rendering its transportation unwieldly.

PROBLEMS FACED BY THE APPLICANT

In view of the above, the present invention is aimed to provide an umbilical cable of smaller dimensions than the conventional cables using triplexed circuits for the same power conducting capacity.

Another problem consists in minimizing or even eliminating the intermediary splices required in the umbilical cables manufactured according to the known techniques.

One further problem consists in producing a cable that is more flexible than the known umbilical cables.

Still another problem consists in providing a manufacturing process less costly than those currently known, both in terms of financial cost and in terms of time expended.

Yet another problem consists in substantially improving the electrical characteristics of the circuits, i.e. reducing voltage and phase imbalance, modulation and voltage drops.

BRIEF DESCRIPTION OF THE INVENTION

Accordingly, the present invention addresses all of the above concerns and provides a constructive arrangement whereby the triplex configuration is not used, the individual conductors being grouped together forming a single assembly, in one sole passage through the cabling machine, with a substantial increase of the mutual spacing between the conductors of different three-phase circuits as compared with the one existing in the conventional triplex configuration, such increase being afforded by the fact that the said conductors are shielded and grouped individually, with the use of separators for the positioning thereof.

According to a further feature of the invention, the cross-section of the shield around each conductor is sized to optimize the electrical characteristics of the circuits as regards voltage and phase imbalance, voltage modulation and voltage drop. Said cross-section may result smaller, equal or larger than the cross-section area of the conductor's central metallic core.

According to still another feature of the invention, the conductors are all grouped together in a helical configuration forming a trefoil grouping for each three-phase circuit.

According to yet another feature of the invention, said trefoils are positioned inside the umbilical cable by insulating fillers placed within the interstitial voids.

DESCRIPTION OF THE DRAWINGS

A more complete appreciation of the present invention and many of the attendant advantages thereof will be readily understood by reference to the following detailed description when taken in conjunction with the accompanying drawings, in which.

DETAILED DESCRIPTION OF THE PREFERRED EMBODIMENT OF THE INVENTION

Figure 2:
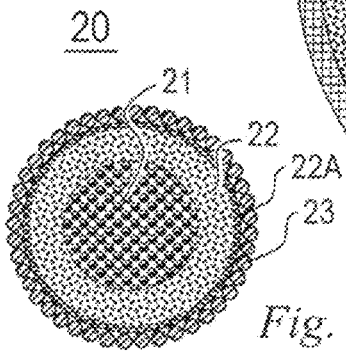
FIG. 2 is a detailed illustration of a conductor of the cable built in accordance with the principles of the invention.

Referring now to FIG. 2, each of the conductors that will form the umbilical cable comprises a central core 21 of conductive metal, preferably of copper but not limited to this metal, surrounded by a sheath of insulating material 22, preferably covered with a semiconductor layer 22A, which is in turn surrounded by the conductors 23 of the metallic shielding, preferably comprised of copper but not limited to this metal. In the exemplary embodiment now described, the sheath 22 is made of a thermoplastic material, preferably polyethylene, applied over said central core by extrusion. However, other materials and techniques may be used to provide the insulating layer 22. The metallic shielding consists of a plurality of metal wires 23, contiguously disposed and in mutual contact, helically wound over the outer face of the insulating sheath 22. The sum of the cross-section areas of the shielding wires is that one which provides an optimizing of the electrical characteristics of the circuits, and may be smaller, equal, or larger than the cross-sectional area of said conductive central core. Thus, in the present exemplary embodiment, the cross-sectional area of the central conductor 21 is equal to 240 square millimeters, and the shielding is comprised by 40 copper wires with a cross-section of 7 square millimeters each, thus resulting in a total area of 280 square millimeters.

Figure 1:
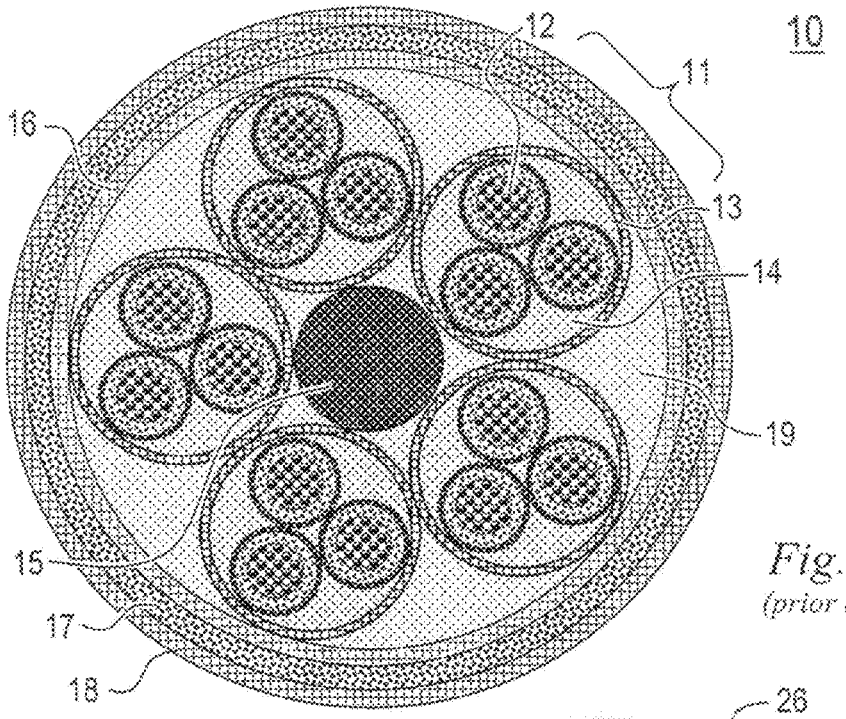
Fig. 1 (prior art)
FIG. 1 shows an umbilical cable built in accordance with the known art.

As previously cited, the invention does not make use of a triplex type arrangement of the conductors 20 (such arrangement being indicated by the numeral 11 in FIG. 1). Instead, after the placement of said shielding wires, the shielded conductors are stored in individual bobbins (in the present example, fifteen bobbins are used) which are then placed in the cabling machine. Since the cross-sectional area of each conductor 20 is substantially less that that of the individual triplex, it becomes possible to store in each bobbin the full length of each conductor, that is, each reel may take up to 12 km of the conductor 20. As a consequence, it is not necessary to interrupt the manufacturing process in order to perform splicing of long cables (up to 12 lam long), since such splices do not exist in the umbilical cables produced in accordance with the invention.

Figure 3:
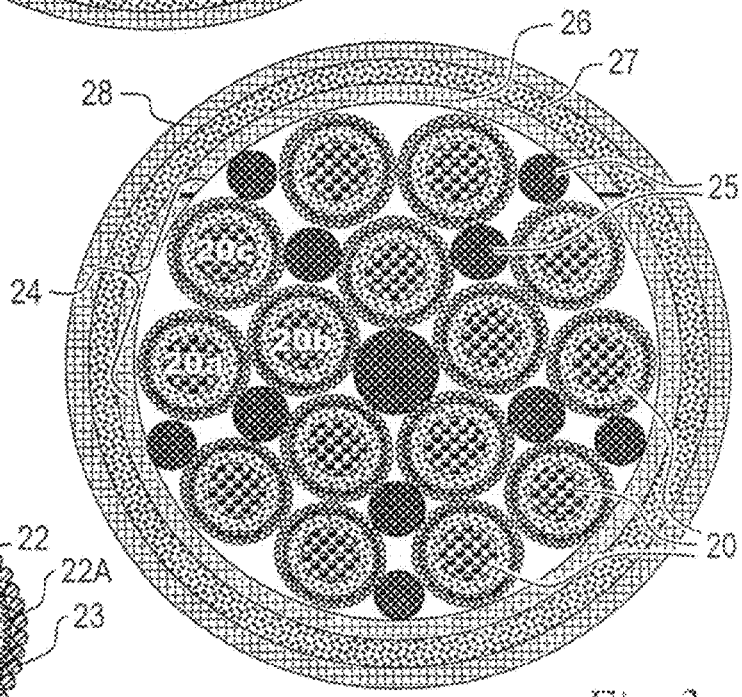
FIG. 3 shows an umbilical cable comprising five three-phase circuits, built in accordance with the principles of the invention.

FIG. 3 shows the cross-section of a finished umbilical cable, with the same power carrying capacity as the one depicted in FIG. 1. As illustrated, the cable built according to the invention comprises five three-phase bundles 24, each one forming a trefoil consisting of three conductors 20*a*, 20*b* and 20*c* grouped together and twisted in a helix, the helix pitch being equal in all trefoils. In the same passage through the cabling machine, said trefoils are wound in a helical pattern. Advantageously, the trefoils are helicoidally joined with a pitch that is substantially the same as the one of the trefoils. Advantageously, the position of the trefoils in the cable is maintained by means of the filler spacers 25, made of insulating material, that are also placed during the same passage through the cabling machine. Preferably, said filler spacers are made of polyethylene. As shown in FIG. 3, said assembly is enclosed by a first sheath 26 made of thermoplastic material, preferably polyethylene, a steel shield 27 being provided externally to said first sheath as well as a second outer sheath 28 also made of thermoplastic material, preferably polyethylene.

In addition to the advantageous weight/diameter ratio, the cable arranged in accordance with the invention is more flexible than the cables of the prior art, resulting in easier handling.

Although the invention has been described based on a specific embodiment thereof, it should be understood that modifications may be introduced thereto without overstepping the limits of the inventive concept. Thus, for example, one or more of the filler spacers 25 may enclose in its center, means for transmission or control of various equipments and systems, said means being provided by one or more electric conductors or one or more optic fibres. Furthermore, the use of circular cross sections is not mandatory either in the conductors or in the filler spacers.

Moreover, the optimizing of the electrical characteristics of the circuits, the phase and voltage unbalance, voltage modulation and voltage drop in each conductor are provided by the proper sizing of the cross-section of the related shield.

Therefore, the invention is delimited and defined by the set of claims that follows.

The invention claimed is:

1. A constructive arrangement in an umbilical cable having an outer wall comprising an external sheath of insulating polymeric material, a metal shielding and an inner sheath of insulating polymeric material enclosing at least two three-phase power supply circuits, each made of three conductors bundled together in a trefoil configuration, each conductor comprising a metal core surrounded by an insulating sheath, each said conductor comprising an individual shield surrounding said insulating sheath, wherein the conductors of each three-phase power supply circuit are grouped helically forming the trefoil, the umbilical cable having a core formed by joining a plurality of the trefoils, and wherein pitches of all the trefoils that form said core are substantially equal.

2. The constructive arrangement in an umbilical cable according to claim 1, wherein said cable is for subsea exploration.

3. The constructive arrangement in an umbilical cable as claimed in claim 1, wherein said external sheath and said inner sheath are in thermoplastic material.

4. The constructive arrangement in an umbilical cable as claimed in claim 1, wherein said three-phase power supply circuits are positioned in the cable by means of filler spacers in insulating material.

5. The constructive arrangement in an umbilical cable as claimed in claim 4, wherein said filler spacers are made of a thermoplastic material.

6. The constructive arrangement in an umbilical cable as claimed in claim 4, wherein said filler spacers have substantially circular cross-sections.

7. The constructive arrangement in an umbilical cable as claimed in claim 1, wherein the individual shield has a cross-section having an area smaller than an area of said metal core.

8. The constructive arrangement in an umbilical cable as claimed in claim 1, wherein the individual shield has a cross-section having an area substantially equal to an area of said metal core.

9. The constructive arrangement in an umbilical cable as claimed in claim 1, wherein the individual shield has a cross-section having an area greater than an area of said metal core.

10. The constructive arrangement in an umbilical cable as claimed in claim 1, wherein said shield comprises a plurality of metal wires surrounding said insulating sheath.

11. The constructive arrangement in an umbilical cable as claimed in claim 1, wherein at least one of the metal core and the metal shielding is formed from a metal selected from copper, aluminum or steel.

12. The constructive arrangement in an umbilical cable as claimed in claim 1, wherein pitches of said trefoils are substantially equal to a pitch of joining of the plurality of trefoils.

13. A method for manufacturing an umbilical cable as claimed in claim 1 comprising the following steps:

a. forming a central metallic core of each conductor;
b. extruding the insulating sheath over said central core;
c. applying the shielding over said insulating sheath;
d. storing each conductor on an individual bobbin;
e. installing, in a cabling machine, as many bobbins as power conductors of any electrical voltage, that will form the umbilical cable;
f. in one single pass through the cabling machine, joining said conductors in groups of three, twisting them in a helical configuration to bundle them into trefoils, all trefoils having a same pitch, and grouping said trefoils together in positions within the cable;
g. extruding the inner sheath of insulating polymeric material over an assembly of trefoils;
h. applying a metal shield over said inner sheath; and
i. extruding an external sheath of insulating polymeric material over said metal shield.

14. The method for manufacturing an umbilical cable as claimed in claim 13, wherein, in said joining step (f), the trefoils are helically joined with a pitch that is substantially the same as a pitch of the trefoils.

15. The method for manufacturing an umbilical cable as claimed in claim 13, wherein, in said joining step (f), filler spacers are joined together with said trefoils.

16. The method for manufacturing an umbilical cable as claimed in claim 13, wherein, after said step (b), a semiconductor layer is overlaid over said insulating sheath.

17. A constructive arrangement in an umbilical cable having an outer wall comprising an external sheath of insulating polymeric material, a metal shielding and an inner sheath of insulating polymeric material enclosing at least two three-phase power supply circuits, each made of three conductors bundled together in a trefoil configuration, each conductor comprising a metal core surrounded by an insulating sheath, each said conductor comprising an individual shield surrounding said insulating sheath, wherein the conductors of each three-phase power supply circuit are grouped helically forming the trefoil, the umbilical cable having a core formed by joining a plurality of the trefoils, and wherein pitches of said trefoils are substantially equal to a pitch of joining of the plurality of trefoils.

18. A method for manufacturing an umbilical cable having an outer wall comprising an external sheath of insulating polymeric material, a metal shielding and an inner sheath of insulating polymeric material enclosing at least two three-phase power supply circuits, each made of three conductors bundled together in a trefoil configuration, each conductor comprising a metal core surrounded by an insulating sheath, each said conductor comprising an individual shield surrounding said insulating sheath, the method comprising:

a. forming a central metallic core of each conductor;
b. extruding the insulating sheath over said central core;
c. applying the shielding over said insulating sheath;
d. storing each conductor on an individual bobbin;
e. installing, in a cabling machine, as many bobbins as power conductors of any electrical voltage, that will form the umbilical cable;
f. in one single pass through the cabling machine, joining said conductors in groups of three, twisting them in a helical configuration to bundle them into trefoils, all trefoils having a same pitch, and grouping said trefoils together in positions within the cable;
g. extruding the inner sheath of insulating polymeric material over an assembly of trefoils;
h. applying a metal shield over said inner sheath; and
i. extruding an external sheath of insulating polymeric material over said metal shield.

* * * * *